United States Patent [19]

Poole et al.

[11] 4,152,100

[45] May 1, 1979

[54] ROTARY PISTON COMPRESSOR HAVING PISTONS ROTATING IN THE SAME DIRECTION

[75] Inventors: Eric J. Poole, Wendover; Sidney J. Morris, High Wycombe, both of England

[73] Assignee: Compair Industrial Ltd., Buckinghamshire, England

[21] Appl. No.: 773,478

[22] Filed: Mar. 2, 1977

Related U.S. Application Data

[63] Continuation of Ser. No. 589,882, Jun. 24, 1975, abandoned.

[51] Int. Cl.[2] ..... F01C 1/24; F04C 17/16; F01C 21/08; F01C 21/12

[52] U.S. Cl. ..... 418/183; 418/196

[58] Field of Search ..... 418/183, 186–188, 418/191, 196, 227

[56] References Cited

U.S. PATENT DOCUMENTS

| | | | |
|---|---|---|---|
| 976,539 | 11/1910 | Bender | 418/186 |
| 2,180,377 | 11/1939 | Whitfield | 418/186 |
| 2,776,086 | 1/1957 | Selden | 418/196 |
| 3,376,789 | 4/1968 | Chambaut | 418/187 |
| 3,426,694 | 2/1969 | Marsh | 418/186 |

FOREIGN PATENT DOCUMENTS

| | | | |
|---|---|---|---|
| 1129962 | 5/1962 | Fed. Rep. of Germany | 418/196 |

*Primary Examiner*—John J. Vrablik

*Attorney, Agent, or Firm*—Mawhinney & Mawhinney & Connors

[57] ABSTRACT

In a rotary piston machine the main rotary piston makes sealing engagement with at least one end wall of the main rotor bore and at least one inlet port is provided in that end wall and is located within the compass of the cylindrical portion of the main rotary piston, the main rotary piston is cut-away to open the inlet port to the working spaces of the machine, which are defined by the main and auxiliary rotor bores, the outer peripheries of the rotary pistons and the end walls of the housing, in order to induce working fluid into such spaces.

7 Claims, 13 Drawing Figures

ROTARY PISTON COMPRESSOR HAVING PISTONS ROTATING IN THE SAME DIRECTION

This is a continuation, of application Ser. No. 589,882 filed June 24, 1975, now abandoned.

BACKGROUND OF THE INVENTION

The invention relates to a rotary piston machine of the type comprising a housing having a cylindrical main rotor bore and at least one cylindrical auxiliary rotor bore parallel to and intersecting the main rotor bore end walls being provided to close both axial ends of the main and auxiliary bores, a main rotary piston having a generally cylindrical portion of lesser diameter than that of the main rotor bore and coaxial therewith, and a summit portion which extends from the cylindrical portion to engage the wall of the main rotor bore, an auxiliary rotor piston mounted in the, or each, auxiliary rotor bore and having a profile which is complementary to that of the main rotary piston such that when the pistons are driven at the same speed in the same direction the, or each, auxiliary rotary piston is in rotating contact or proximity with the periphery of the main rotray piston. Such a rotary piston machine will herein be referred to as "a rotary piston machine of the type described".

SUMMARY OF THE INVENTION

According to the invention, there is provided a machine of the type described wherein the main rotary piston makes sealing engagement with at least one end wall of the main rotor bore and at least one inlet port is provided in that end wall and is located within the compass of the cylindrical portion of the main rotary piston, and wherein the main rotary piston is cut-away to open the inlet port to the working spaces of the machine, which are defined by the main and auxiliary rotor bores, the outer peripheries of the rotary pistons and the end walls of the housing, in order to induce working fluid into such spaces.

The advantage of a machine according to the invention over previous known machines of the type described, for example as described in British patent specification No. 997,878, is that it provides relatively simplified and more reliable inlet porting which does not require auxiliary moving parts.

The cut-away portion of the main rotary piston is preferably so shaped that the trailing flank of the main rotary piston does not seal with the periphery of an auxiliary rotary piston along the entire length thereof before that auxiliary rotary piston has rotated to a position in which a volume of working fluid is isolated from the main rotor bore in a space defined by the periphery of that auxiliary rotary piston, the auxiliary rotor bore thereof and the end walls of that auxiliary rotor bore whereby that volume of working fluid is at intake conditions and has not been compressed in the machine.

Preferably an annular inlet port is provided in an end wall of the main rotor housing to be opened continuously by the cut-away portion of the main rotary piston.

It is further preferred that an inlet port is provided in each end wall of the main rotor housing to minimize axial thrusts from intake pressures. In some arrangements, said cut-away portion may extend along the entire length of the main rotary piston.

In a preferred arrangement of a machine according to the invention, two auxiliary rotary pistons are provided at diametrically opposed locations.

It is further preferred that an imaginary line passing through the axis of the main rotary piston and a point of intersection of the main rotor bore and an auxiliary rotor bore is inclined at an angle in the range 22° to 28° and preferably in the range 24° to 26°, to an imaginary line passing through the axis of the main rotor bore and the axis of that auxiliary rotor bore.

DESCRIPTION

Figure 1:
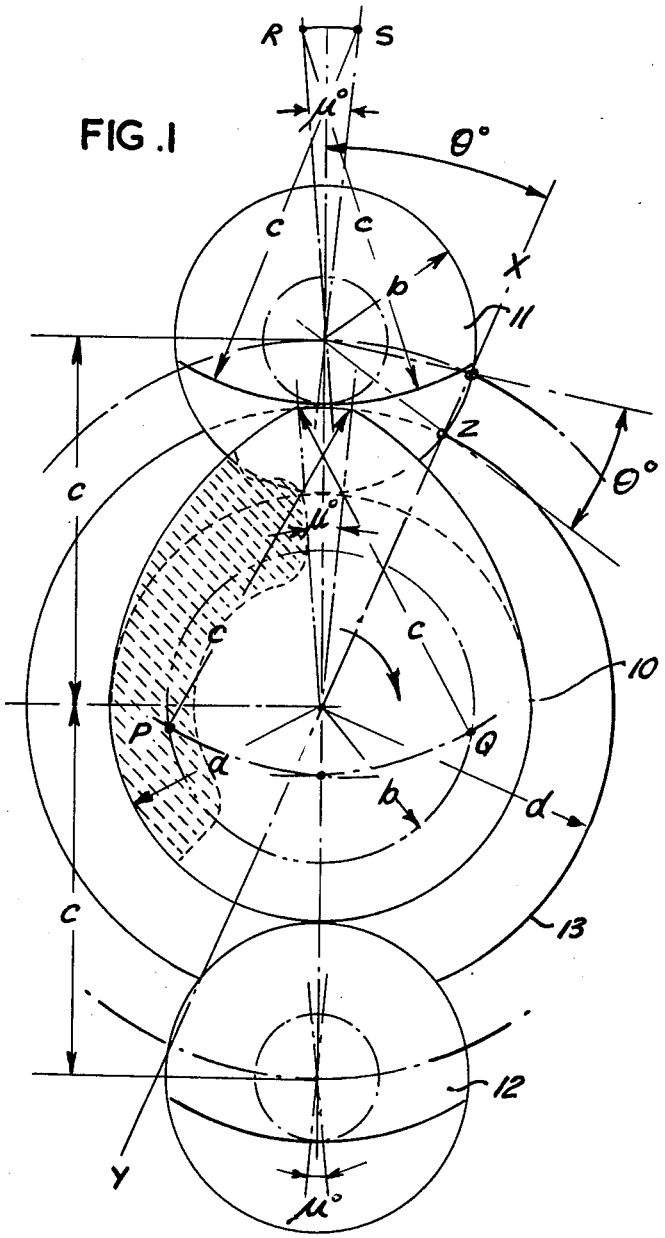
FIG. 1 shows diagrammatically the geometrical construction of a rotary piston machine embodying the invention having a main rotary piston and two diametrically opposed auxiliary rotary pistons.

Referring to the drawings there is shown a rotary piston machine having a main rotary piston or rotor 10 and two auxiliary rotary pistons or rotors 11 and 12 parallel to the main rotor and at diametrically opposed locations with respect to the main rotor, the rotors being driven in the same direction and at equal speeds. The rotors are located in a housing 13 having three parallel bores which intersect one another and contain the three rotors 10, 11 and 12 respectively. The rotary piston machine shown in the drawings will be described below when operating as an air or gas compressor in which rotation of the rotors define three active working spaces or cells in which compression and discharge takes place successively during a 540° complete working cycle, the compressor giving two equal discharge pulses per revolution of the main rotor. The compressor may be a single stage device or one stage of a multistage device and the unit may be operable in normally lubricated, non-lubricated or coolant injected form. Complete dynamic balance of the rotary parts may be achieved by appropriate disposition of the mass centres of the revolving parts.

The basic geometry of the shape of the rotors and the housing 13 will now be described with specific reference to FIG. 1. The axes of the three rotors 10, 11 and 12 are marked off along the line of centres with the axes of the auxiliary rotors being spaced along that line by a distance C from the axis of the main rotor. A line XY is drawn through the axis of the main rotor at an angle $\theta°$ to the line of centres. The chordal distance across an arc of radius C subtended at the centre of the main rotor and extending between the aforesaid line of centres and the line XY gives the radius b of the auxiliary rotors. The main rotor base circle of radius a is then drawn tangent to and between the auxiliary rotor circles. The construction proceeds by drawing a radius to the upper auxiliary rotor circle, which radius makes an angle of $\theta°$ to the radius of that circle which provides the chord to the aforesaid arc between the line of centres and the line XY, the angle $\theta°$ being measured in the direction towards the main rotor axis. The last constructed radius passes through the upper auxiliary circle at a point Z through which the line XY also passes. The radial distance from Z to the axis of the main rotor gives the radius d for the main rotor casing and for the main rotor tip as described below. Two circles centred respectively at the axes of the auxiliary rotors are then drawn tangent to the circle defining the main rotor casing to provide root circles for the auxiliary rotors.

The auxiliary circle is then constructed concentric with the axis of the main rotor within the main rotor base circle, as shown by chain dotted lines in FIG. 1. In the embodiment shown in FIG. 1 the main rotor has a land tip which is produced by drawing an arc of radius d centred at the centre of the main rotor which arc subtends at an angle of $\mu°$ and has equal portions on either side of the aforesaid line of centres. Arcs of radius equal to the centre distance C are drawn from the opposite edges of the land tip to intersect the constructed auxiliary circle centred on the axis of the main rotor at points P and Q. The flanks of the summit portion of the main rotor are then constructed by drawing arcs of radius C centred at P and Q respectively and extending from respective sides of the land tip of the main rotor and tangent to the main rotor base circle. The auxiliary rotor profile is then produced by constructing the land tip of the main rotor but centred on the axis of the auxiliary rotor and drawing arcs at radius c centred at R and S respectively which represent the extremities of the land tip of the main rotor to provide two arcs which extend from the auxiliary circle and intersect on the aforesaid line of centres. The constructed radii passing through R and S respectively are extended below the axis of the auxiliary rotor and an arc is drawn between those extended portions of those radii, centred at the centre of the auxiliary rotor and tangent to the land tip of the main rotor to provide a central portion of the lower profile of the auxiliary rotor between the circular arcs of the radius C providing the remainder of the lower profile of the auxiliary rotor.

In an alternative embodiment the tip of the main rotor is defined by a line extending in the axial direction of the rotor so that in cross-section it is represented by the point on the aforesaid line of centres at the position where the main casing circle intersects the line of centres. The points P and Q are then defined by drawing an arc of radius C which is subtended at that point. The flanks of the summit portion of the main rotor are then constructed by drawing arcs of a radius equal to the centre distance C tangent to the main rotor base circle, the arc centres lying on the constructed circle at P and Q. The lower profile of the auxiliary rotors will then correspond to an arc centred at the tip of the summit of the main rotor and extending between the points P, Q.

The above described construction is such that, in using profile arcs of radius equal to the unity rotor centre distance C, all points of discontinuity of curvature on the profiles of both main and auxiliary rotor types will lie on extensions of those arcs about the respective centres on which they are generated. This construction in which the point Z and hence main casing and auxiliary circle root radius are fixed, is preferred for the inherent simplicity of describing angular attitudes of the respective rotors and of calculating the associated spaces during the working cycle. It will also be possible however for the auxiliary circle root radius to be fixed arbitrarily whence the point Z and main rotor casing radius d will not then depend on the angle $\theta°$. The geometry can be made to perform in a similar manner, but with complexity of the calculation of the working spaces in the machine.

The angle $\theta$ is preferably between 24° and 26° depending on the land tip angle $\mu°$ in order to approach the highest displacement for a unit centre distance C. Angle $\theta$ may conveniently be between 22° and 28° where valve porting or special duty permits.

The axial length of the main rotor working space is preferably three quarters of the rotor centre distance C for conditions giving the minimum length of seal line at the running clearance between and across the rotors and casing walls, but the axial length may be varied where valve porting or special duty permits.

The land tip angle $\mu°$ is chosen arbitrarily to facilitate manufacture and to accommodate the shape of the discharging porting, which is described below. A preferred angle of $\mu°$ equal to 10° is used but this may conveniently be between 0° to 15°.

The profile and casing radii, and axial length are written in terms of centre distance C between rotors to enable sizes, areas or volumes to be readily manipulated for various machine capacities, since capacity is then a function of centre distance.

The main rotor rotates in the direction of the arrow shown in FIG. 1, and a portion, which is shown as a shaded area in FIG. 1, of the trailing flank of the main rotor is cut away, for a purpose described later in connection with the inlet porting of the machine. The angle subtended over the cut away portion of the main rotor is $(180 + \mu/2 - 2\theta)°$ which in a preferred case is between 137° and 133° giving the condition where a seal contact is established by the main rotor with the auxiliary rotor periphery at the moment when the auxiliary rotor space isolates and cuts off from the main working space, as described in the sequence of operation of the machine below. At this condition the sealed working space in the main rotor bore holds the largest captive volume which is subsequently compressed in the machine, and the significance of the construction angle $\theta°$ can be shown to ensure the captive volume is at or near a maximum value for the unity centre distance C.

A preferred embodiment of a rotary machine incorporating the geometry of FIG. 1 will now be described with reference to FIGS. 2 to 6 of the drawings.

As described above, the rotary machine has a main rotor 10 and two auxiliary rotors 11, 12 parallel to the main rotor and at diametrically opposite locations with respect to the main rotor. The three rotors are located in housing 13 in parallel bores which intersect one another.

Figure 2:
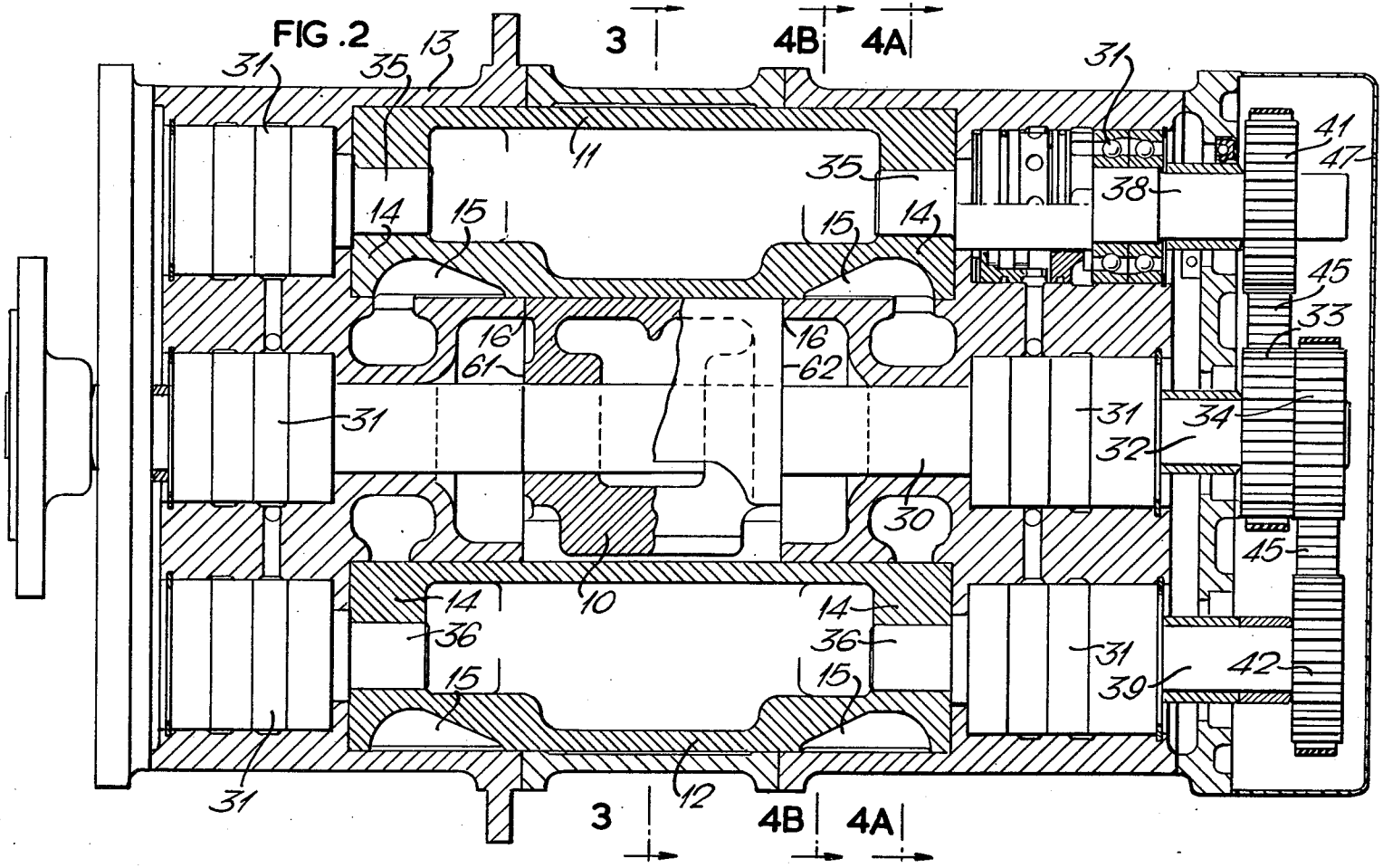
FIG. 2 is a section along line 1 — 1 of FIG. 3 through a rotary piston machine embodying the invention and having a main rotary piston and two diametrically opposed auxiliary rotary pistons.

As will be seen most clearly in FIG. 2, the main rotor 10 includes a shaft 30 which is supported for rotation at its ends, in known way, by sets of seals and bearings 31. An extension 32 of shaft 30 extends axially beyond the end of the housing 13 and two equally sized sprockets 33, 34 are fixed to extension 32.

Auxiliary rotors 11, 12 include shafts 35, 36 respectively which are also supported for rotation at their ends by sets of seals and bearings 31. In FIG. 2 only one such set of seals and bearings has been illustrated for clarity.

Shafts 35, 36 have extensions 38, 39 respectively which protrude axially beyond the end of housing 13 parallel to and equi-distantly spaced from extension 32. Sprockets 41, 42 of identical size to sprockets 33, 34 are fixed to extensions 38, 39. Sprocket 33 is drivingly connected to sprocket 41 by a toothed driving belt 45 and sprocket 34 is drivingly connected to sprocket 42 by a similar driving belt 45. The arrangement is such that the three shafts 30, 35, 36 and hence the three rotors are driven in the same direction at the same speed. The sprockets and belts are enclosed by a casing 47 attached to the end of the housing 13.

Figure 3:
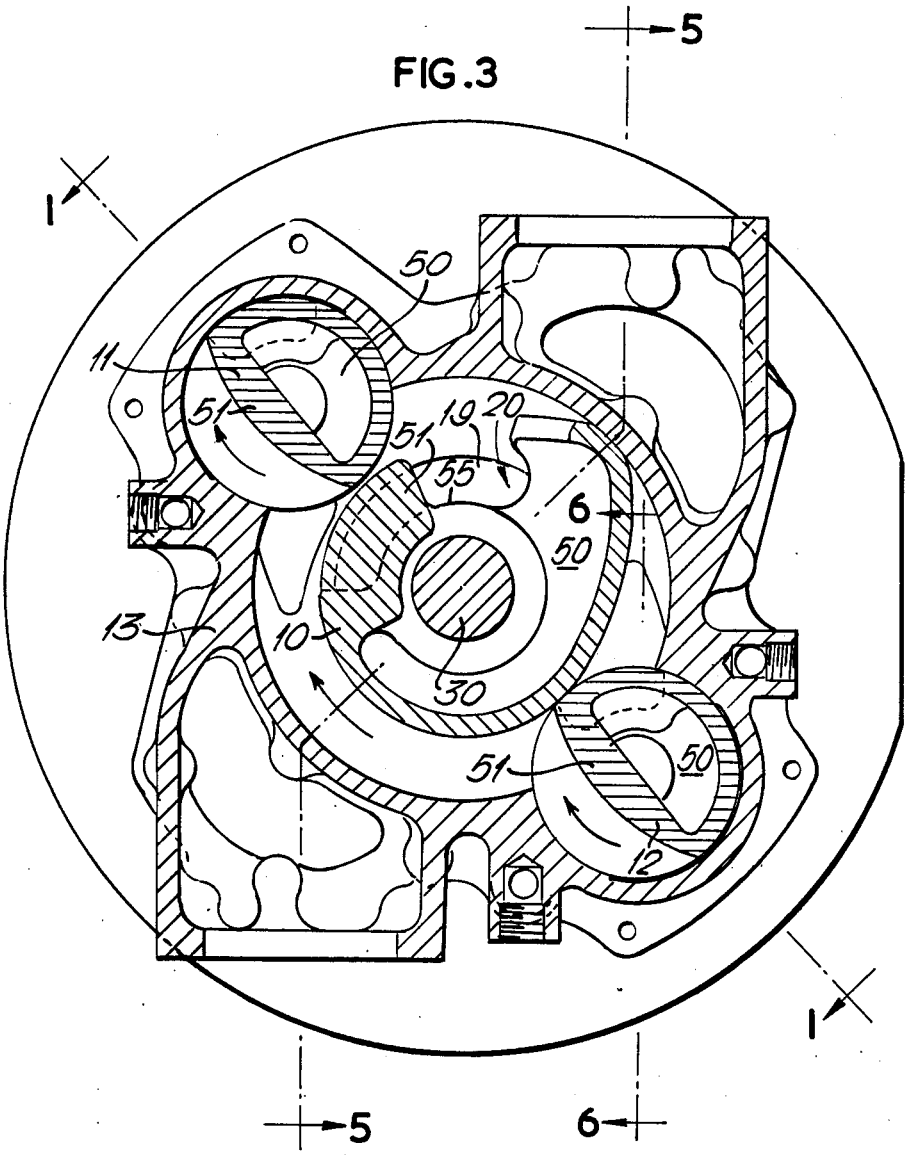
FIG. 3 is a section along the line 3 — 3 of FIG. 2.
Figure 4:
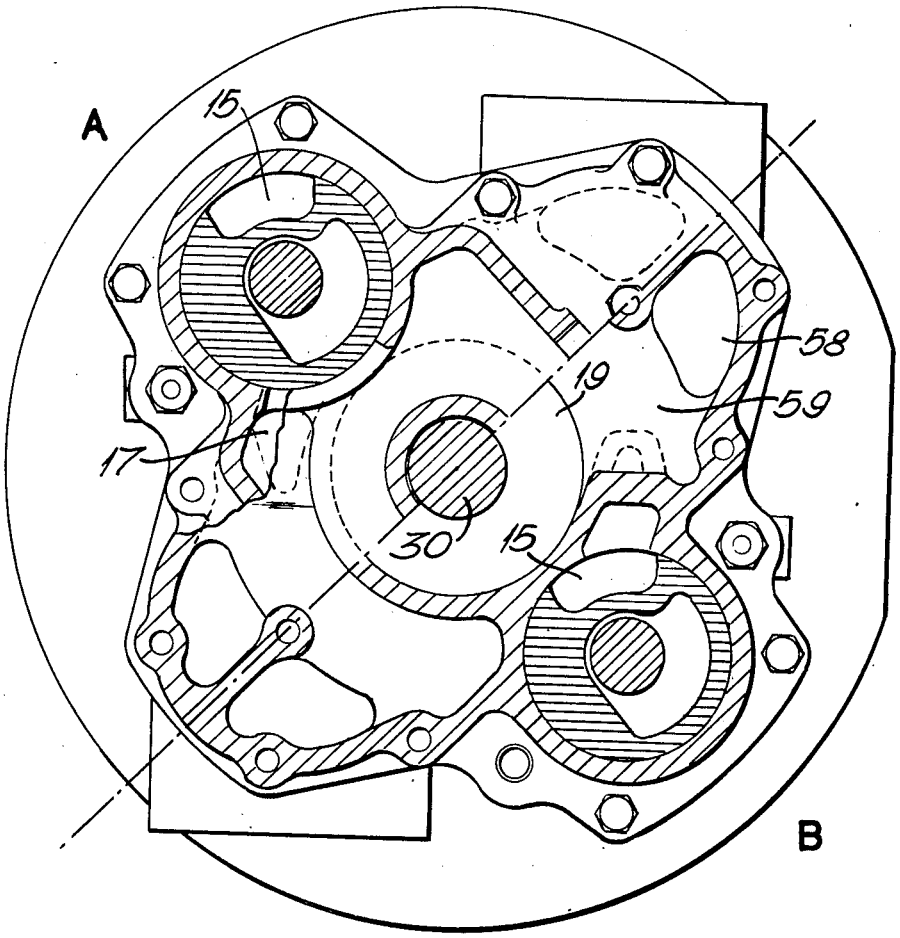
FIG. 4A is a part-section along the line 4A — 4A of FIG. 2.
FIG. 4B is a part-section along the line 4B — 4B of FIG. 2.

Referring now to FIG. 3, it will be seen that the line of centre of the rotors is arranged in the housing at approximately 45° to the vertical. This arrangement is chosen for ease of assembly when the machine is used as one stage of a multi-stage compressor.

The peripheral shape of the working length of the rotors 10, 11, 12 is as described with reference to FIG. 1, but the rotors are constructed with hollow interior portions 50 and peripheral flanges 51 of varying thickness in order that dynamic balance of each rotor may be achieved.

Figure 5:
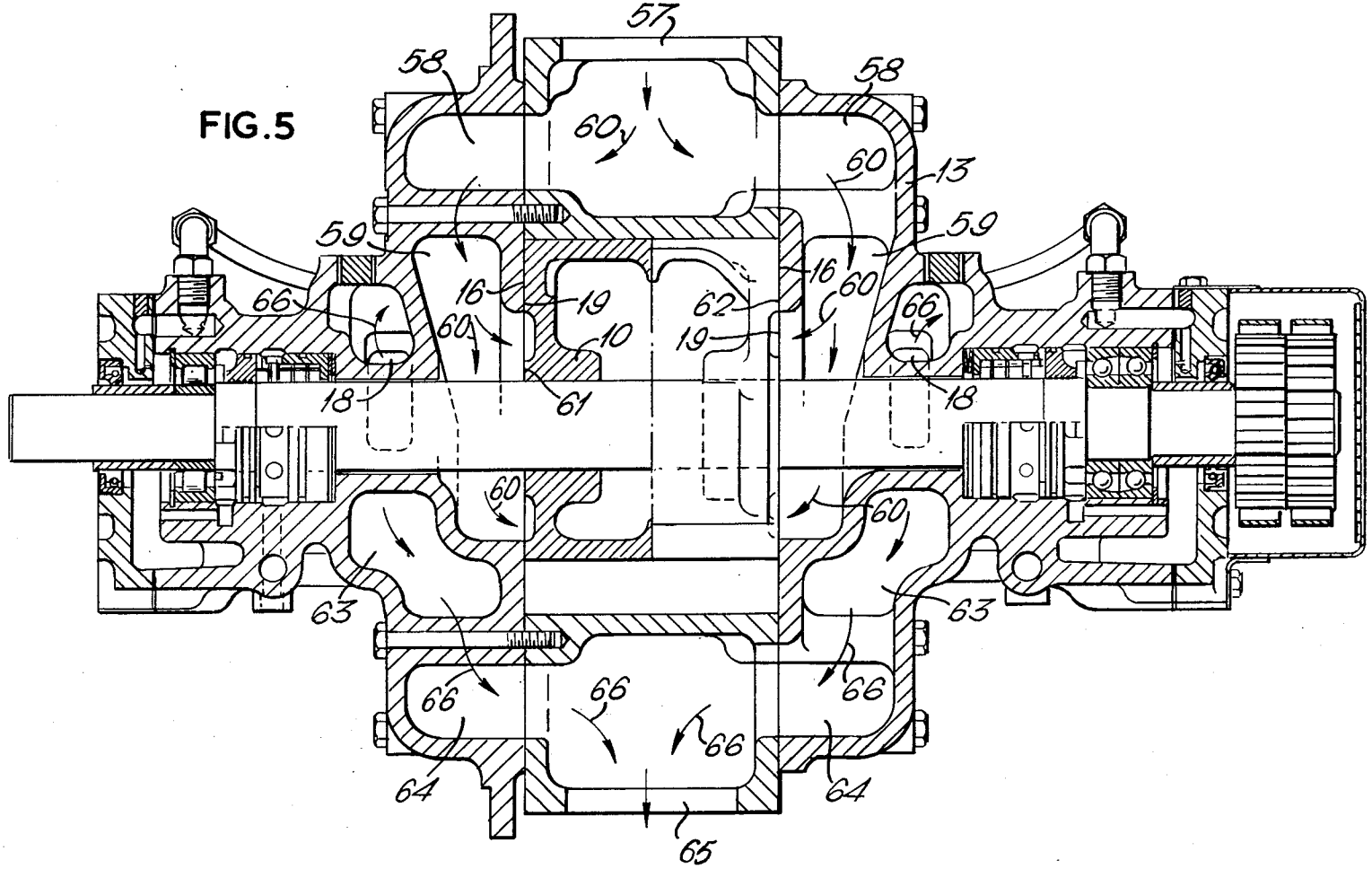
FIG. 5 is a section along the line 5 — 5 of FIG. 3.

The air inlet path to the machine will now be described with particular reference to FIGS. 3, 4B and 5.

Each end wall 16 of the main rotor housing is formed with an annular inlet port 19 centred at the axis of the main rotor. The inlet port 19 lies completely within the main rotor base circle radius a. The arcuate base portion 55 of the cut away 20 in the main rotor defines the inner periphery of inlet port 19 which is then continually exposed by the cut away portion 20 as the main rotor rotates. Air is supplied to the inlet port 19 from an inlet orifice 57 in the top of the housing 13 via ducts 58, 59 formed in the housing. The path of the inlet air to the inlet ports 19 is shown by arrows 60 in FIG. 5. Although each inlet port is described as annular, each port may comprise a plurality of arcuate ports arranged on a common circle. The divisions between such ports will increase the strength of the housing.

The air discharge path from the machine will now be described with particular reference to FIGS. 2, 4A, 5 and 6.

Figure 6:
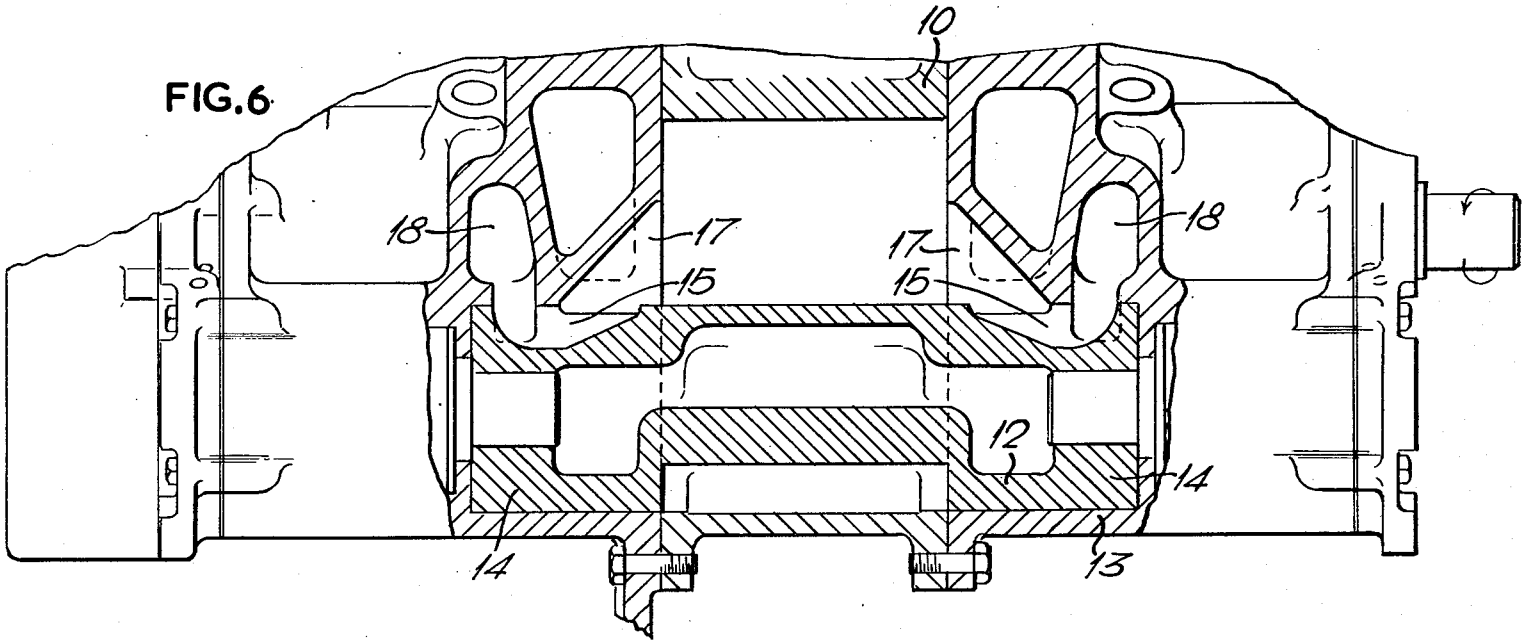
FIG. 6 is a scrap section along the line 6 — 6 of FIG. 3.

The auxiliary rotors 11, 12 each protrude axially in both directions beyond the end faces 61, 62 of the main rotor 10. The protruding end portions of the auxiliary rotors are referenced 14. A part of the periphery of each end portion 14 is recessed to provide a rotary link port 15. Each end wall 16 of the main rotor bore is formed with a pair of transfer ports 17 at diametrically opposed locations, leading from the main rotor bore of the housing. The housing is also formed with two pairs of discharge ports 18, one pair being formed adjacent to each end wall 16 of the main rotor housing. The ports 18 are axially aligned with the ports 17 and lead from a portion of the wall of the housing opposite an adjoining portion of the periphery of an auxiliary rotor. The ports 17 and 18 are isolated from one another by the end portion 14 of the auxiliary rotor at all times except when the rotary link port 15 registers with ports 17 and 18, as shown in FIG. 6 to allow flow from port 17 through the link port 15 to the discharge port 18.

The compressed air is discharged from ports 18 via ducts 63, 64 to discharge orifice 65. The path of the discharge air is indicated by arrows 66 in FIG. 5.

Operation of the compressor will now be described with reference to FIGS. 7 to 13 of the drawings. In these figures, reference numerals of certain parts of the machine have only been inserted in FIG. 7 for clarity. Considering first the position shown in FIG. 7 of the drawings, the main rotor and auxiliary rotors define between themselves and the bores and end walls of the housing 13, three working spaces or cells 1, 2 and 3. Cell 1 has just been cut off from the inlet port 19 which is then exposed by cut-away portion 20 of the main rotor, by engagement of the lower edge of the main rotor with auxiliary rotor 12 so that cell 1 is charged with a volume of air ready for compression and this volume is the maximum volume which can be held captive in any one cell immediately prior to compression thereof. Since immediately before the position shown in FIG. 4 cell 1 and cell 2 were linked by cut-away portion 20, the air or gas isolated in the crescent-shaped space 21 from the working spaces or cells of the machine by auxiliary rotor 12 is also at intake conditions so that no work has been done on the air which is trapped in space 21 and which is dumped into another cell later on in the cycle as described below.

Cell 2 is at intake conditions so that this cell is still being charged with air. Cell 3 is reaching the end of a discharge of compressed air through transfer port 17 which is not yet completely masked by rotor 10, through link port 15 which is in a position in which it provides a connection between casing port 17 and discharge port 18, and finally through discharge port 18.

Figure 7:
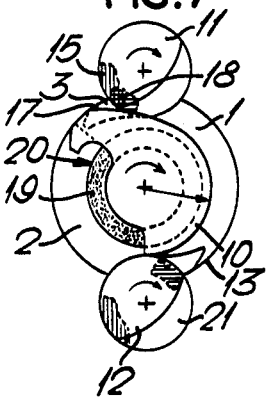
FIGS. 7 - 13 are diagrammatic views of the machine shown in FIGS. 1 to 6, showing successively working positions of the rotary pistons of the machine and showing an operating cycle.
Figure 8:
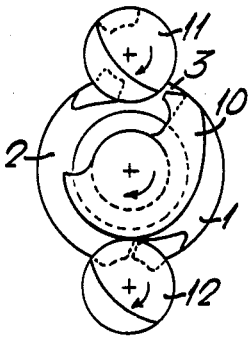

As the rotors move between the positions shown in FIG. 7 and the positions shown in FIG. 8 air or gas in cell 1 is compressed, air or gas in cell 3 has been completely discharged and cell 3 is now commencing an intake of a fresh charge of air or gas since it is connected to cell 2 by cut away portion 20 so that it can induce air or gas from the inlet port 19. Cell 2 is still at inlet conditions and continues to induce air since the inlet 19 is continuously exposed by cut-away portion 20.

Figure 9:
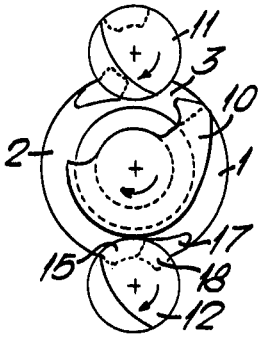

When the rotors reach the position shown in FIG. 9 compression in cell 1 is complete and the rotary link port 15 of auxiliary rotor 12 is about to connect casing port 17 to the discharge port 18 to allow discharge of the compressed air or gas from cell 1. Cells 2 and 3 are still inducing air or gas. The air or gas in crescent space 21 is now dumped into cell 2 but since this air or gas is also at inlet conditions there has been no work done on it which would otherwise be lost when it is dumped back into cell 2.

Figure 10:
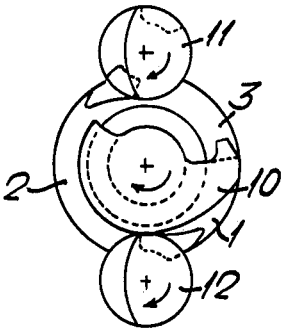

In the position shown in FIG. 10 the rotary link port 15 is completely open providing a full-flow from the discharge duct port 18 to the casing transfer port 17. Cells 2 and 3 are still open to the inlet port 19 and to each other as they are interconnected by cut away portion 20 in the main rotor.

Figure 11:
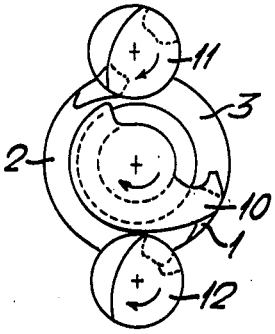

When the rotors have reached the position shown in FIG. 11 the full flow discharge is complete and the rotary link port 15 is about to commence closing the communication between the casing transfer port 17 and the discharge duct port 18. The main rotor 10 is also about to commence closing the casing transfer port 17. It will be seen that the radially inner arcuate boundary of the casing transfer port 17 is defined by the adjacent portion of the leading flank of the main rotor when the main rotor is in the position shown in FIG. 1b. The shape of the casing transfer port 17 is such that rotation of the main rotor beyond the position shown in FIG. 11 progressively masks the port and reduces the port opening at almost exactly the same uniform rate as that at which the rotary valve link port 15 closes.

Figure 12:
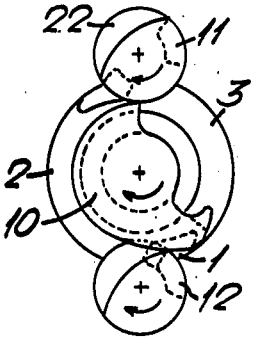

When the rotors have rotated to the position shown in FIG. 12 the main rotor has almost masked casing transfer port 17 and the rotary link port 15 has almost closed so that cell is nearing the end of its compression and discharge stroke. Cell 2 has just been shut off from cell 3 and therefore from inlet port 19 so that cell 2 is charged with its maximum captive volume ready for a compression stroke therein. It will also be noted that the air or gas isolated in crescent-shaped space 22 from the working spaces or cells of the machine by the rotary valve 11 is at intake conditions because, just prior to it being trapped, this volume formed a part of cell 2 which was then connected by cut-away portion 20 to inlet port 19. Therefore the crescent volume 22 has not had any work done on it which would otherwise have been lost when this volume is dumped into cell 3 later on in the cycle of the machine when cell 3 will still be at induction conditions.

Figure 13:
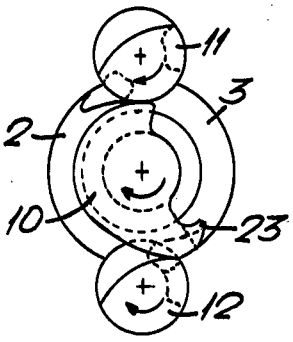

When the rotors have rotated to the position shown in FIG. 13 compression will now have started in cell 2. Cell 3 is still inducing air or gas through inlet 19. Cell 1 has now completely discharged the compressed air or gas and the rotary link port 15 is now completely closed and the main rotor completely masks casing transfer port 17. It will be seen that the main rotor has a portion 23 extending into the cut-away portion 20 from the trailing edge of the land tip of the rotor, the land tip and the portion 23 being provided and shaped to completely mask the transfer port 17 until the discharge is complete and link port 15 is closed so that there will be no back flow of compressed air or gas from the discharge duct port 18 and the link port 15 into cell 3 which is at intake conditions. The work done on the compressed air remaining in the transfer port 17 will in fact be lost when the main rotor rotates to uncover this port but this dead space can be kept extremely low in comparison to the captive volume which can be held and compressed so that the loss of efficiency will be very small in this respect. As the auxiliary rotor 12 rotates a volume of compressed air or gas will be held in the link transfer port 15 which therefore remains charged with compressed air or gas to await successive discharge from a subsequent cell. It will be appreciated that this virtually eliminates dead space effect from the link port and reduces shock when the link port valve opens. The above described sequence is then repeated so that compression then takes place in cell 2 and discharge occurs through the link port 15 in auxiliary valve 11. Therefore, for a 360° rotation of the machine, two discharge pulses occur one through each set of transfer, link and discharge duct ports. A further 180° rotation again corresponds to the above described sequence but this time air or gas is compressed in coil 3 and discharged to the link port in auxiliary rotor 12 thereby completing a 540° cycle of the machine in which air or gas is compressed in each of the three cells successively.

The intake ports are applied at both axial ends of the housing to ensure that no axial thrust from intake pressure on unbalanced areas occurs. Each intake port is pitched in an annular form as described above in the housing end wall to provide adequate flow area irrespective of the angular attitude of the main rotor. The annular port at each end is liked to ducts which may be combined to accommodate intake connection or which may have individual intake connections. It should be noted that a maximum captive volume which is compressed for each 180° rotation exceeds one half of the potential space which can be swept out during one revolution since the successive cells overlap. The trailing profile of the main rotor is always under intake conditions and the spaces or cells in the machine which are not under compression conditions are always linked by the cut away portion in the main rotor and are fed from the common inlet ports 19. The flow into the casing therefore through these inlet ports is continuous over the complete cycle, and approaches steady flow conditions.

The discharge transfer ports 17 and 18 and rotary link port or valve 15 are located at both ends of the housing to ensure no axial thrusts from discharge pressures on unbalanced areas will occur. The rotary valves will operate once per complete revolution, and their timed diametrical disposition about the main rotor will permit two regular discharge pulses per revolution of the rotor system. The discharge duct ports are led away to a combined duct or manifold, whose internal volume may be decided for purposes of minimizing the discharge pressure pulsation effect, and which will have a single terminal connection.

The main rotor tip land angle $\mu°$ assumes importance in fixing the discharge port facing shape in the housing end walls.

We claim:

1. A rotary piston compressor comprising:

a housing having a cylindrical main rotor bore and at least two auxiliary rotor bores formed parallel to and intersecting the main rotor bore;

end walls closing both axial ends of the main and the auxiliary rotor bores;

a main rotary piston rotatably mounted in the main rotor bore and having end portions in sealing engagement with the end walls of the main rotor bore, said main piston having a generally cylindrical portion of lesser diameter than the diameter of the main rotor bore and having a summit portion which extends from the cylindrical portion to engage the wall of the main rotor bore and define a leading flask and a trailing flask of the main rotary piston;

an auxiliarly rotary piston rotatably mounted in each auxiliary rotor bore and having profile which is complementary to that of the main rotary piston such that when the auxiliary and main pistons are driven at the same speed in the same direction of rotation each auxiliary rotary piston makes sealing engagement with the periphery of the main rotary piston and an imaginary line passing through the axis of the main rotary piston and a point of intersection of the main rotor bore and an auxiliary rotor bore as inclined at an angle in the range of 24° to 28° to an imaginary line passing through the axis of the main rotor bore and the axis of that auxiliary rotor bore;

a captive cell in which working fluid is to be compressed, said captive cell being defined in use at any instant by the main and at least one auxiliary rotor bore, the leading flank of the main rotary piston, the outer periphery of at least the auxiliary rotary piston next adjacent to the summit of the main rotary piston in its direction of rotation and the end walls of the housing;

a pathway for air formed in the housing and extending externally thereof;

inlet ports provided in each end wall of the main rotor housing to minimize axial thrusts from intake pressures, said inlet ports located entirely within the compass of the cylindrical portion of the main rotary piston and directly communicated with the air pathway and an inlet opening formed in the end portion of the main rotary piston, said inlet opening directly communicating with the inlet port which is continually exposed thereby as the main rotor rotates and said inlet opening being operable to connect the inlet port to a portion of the interior of the housing isolated from the captive cell to induce working fluid into said portion; and, outlet means in the housing for the discharge of the compressed air.

2. A compressor as claimed in claim 1 in which the auxiliary rotary pistons are provided at diametrically opposed locations.

3. A compressor as claimed in claim 1 in which the angle is in the range 24° to 26°.

4. A compressor as claimed in claim 1, in which the relative rotational orientation of the main and auxiliary rotary pistons is such that, in the rotational position when the captive cell is formed, the auxiliary rotary piston defining part of the periphery of the captive cell simultaneously isolates a space defined by the periphery of said auxiliary rotary piston and its respective auxiliary rotor bore so that no work is done by the compressor on the fluid enclosed in said space.

5. A compressor as claimed in claim 9 in which the inlet opening comprises an arcuate cut-away portion of the cylindrical portion formed in the trailing flank of the main rotary piston, said cut-away portion opening the inlet port to a portion of the interior of the housing isolated from the captive cell and being so shaped that the inlet port remains in communication with an auxiliary rotor bore and the trailing flank of the main rotary piston does not seal with the periphery of the auxiliary rotary piston mounted in said auxiliary rotor bore along the entire length thereof before that auxiliary rotary piston has rotated to a position in which a volume of working fluid is isolated from the main rotor bore in a space defined by the periphery of that auxiliary rotary piston, the auxiliary rotor bore thereof and the end walls of that auxiliary rotor bore whereby that volume of working fluid is at intake conditions and has not been compressed in the compressor.

6. A compressor as claimed in claim 5 in which the inlet port provided in an end wall of the main rotor housing is annular and is opened continuously by the cut-away portion of the main rotary piston.

7. A compressor as claimed in claim 5 in which the cut-away portion extends along the entire length of the main rotary piston.

* * * * *